US010137913B2

(12) United States Patent
Giebel-Roder

(10) Patent No.: US 10,137,913 B2
(45) Date of Patent: Nov. 27, 2018

(54) METHOD FOR SWITCHING A TRAIN ON AND OFF, AND ROUTE AND TRAIN CONFIGURATION FOR CARRYING OUT THE METHOD

(71) Applicant: SIEMENS AKTIENGESELLSCHAFT, Munich (DE)

(72) Inventor: Marion Giebel-Roder, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 225 days.

(21) Appl. No.: 15/025,955

(22) PCT Filed: Sep. 12, 2014

(86) PCT No.: PCT/EP2014/069495
§ 371 (c)(1),
(2) Date: Mar. 30, 2016

(87) PCT Pub. No.: WO2015/043983
PCT Pub. Date: Apr. 2, 2015

(65) Prior Publication Data

US 2016/0236697 A1 Aug. 18, 2016

(30) Foreign Application Priority Data

Sep. 30, 2013 (DE) ..... 10 2013 219 721

(51) Int. Cl.
*B61L 27/04* (2006.01)
*B61L 15/00* (2006.01)

(52) U.S. Cl.
CPC ..... *B61L 15/0063* (2013.01); *B61L 27/04* (2013.01)

(58) Field of Classification Search
CPC ..... B61L 15/0063; B61L 27/04
See application file for complete search history.

(56) References Cited

U.S. PATENT DOCUMENTS 4,344,138 A * 8/1982 Frasier ..... B60T 8/1705 105/61
8,477,067 B2 * 7/2013 Kanner ..... G01S 19/11 342/357.29

(Continued)

FOREIGN PATENT DOCUMENTS

AU 2009202474 A1 1/2010
CN 1184048 A 6/1998

(Continued)

OTHER PUBLICATIONS

ETCS, "System and requirements and specifications (SRS)—Annexe A3", European Rail Research Instutute ERR, 1996, pp. 1-18.

*Primary Examiner* — Kimberly S Berona
*Assistant Examiner* — Jordan S Fei
(74) *Attorney, Agent, or Firm* — Laurence Greenberg; Werner Stemer; Ralph Locher

(57) ABSTRACT

A method and a route and train configuration for switching a train off and on in a parking position include a train side automatic train control device and a route side train monitoring system. In order to switch the train on and off economically and independently from personnel, the following steps are provided: A) entering the parking position, wherein a train reclosing unit, together with a route side coupling module connected to the train monitoring system, establishes an electrical connection; B) switching off train side subsystems using the train control device; C) shutting down and switching off the train control device; D) event triggered reactivation of the train control device using the train reclosing unit; E) switching on remaining train subsystems by using the train control device, and F) exiting the parking position, while separating electrical connection between the reclosing unit and the coupling module.

7 Claims, 1 Drawing Sheet

(56) References Cited

U.S. PATENT DOCUMENTS

| | | | | |
|---|---|---|---|---|
| 8,548,655 | B2 * | 10/2013 | Kanner | B61L 29/243 105/61 |
| 2009/0187294 | A1 * | 7/2009 | James | B61L 25/025 701/19 |
| 2014/0012439 | A1 * | 1/2014 | Dimmer | B61L 25/025 701/19 |

FOREIGN PATENT DOCUMENTS

| | | | |
|---|---|---|---|
| CN | 1438146 | A | 8/2003 |
| DE | 102010061878 | A1 | 5/2012 |
| DE | 102011077760 | A1 | 12/2012 |
| EP | 0106983 | A1 | 5/1984 |
| EP | 2599683 | A1 | 6/2013 |
| WO | 2012069325 | A1 | 5/2012 |

* cited by examiner

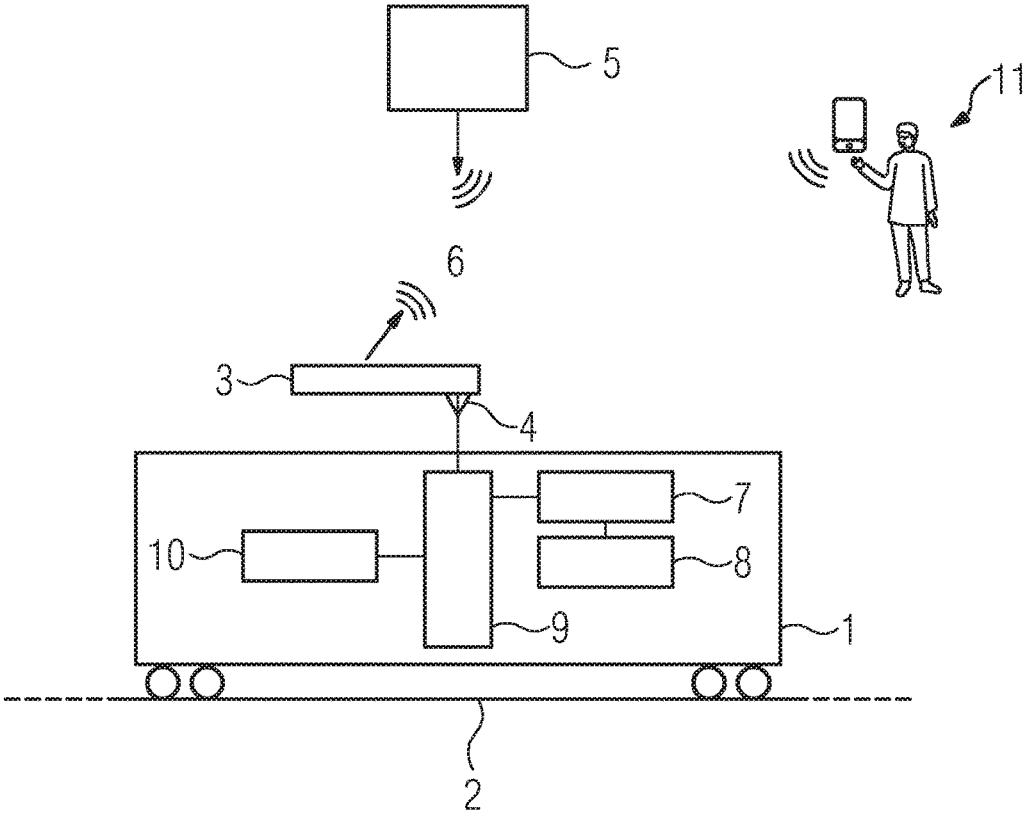
5
11
6
3
4
7
10
8
9
1
2

METHOD FOR SWITCHING A TRAIN ON AND OFF, AND ROUTE AND TRAIN CONFIGURATION FOR CARRYING OUT THE METHOD

BACKGROUND OF THE INVENTION

Field of the Invention

The invention relates to a method for switching a train off and on in a parking position, wherein an automatic train control device is provided on the train side and a train monitoring system is provided on the route side, and to a route and train configuration for carrying out the method.

Trains are not usually operated continuously 24 hours a day. During a break in operation, the train is parked in a parking region assigned to the track infrastructure. Modern train control devices, for example with ETCS—European Train Control System—components, require precise position data not just for moving trains, but also for parked trains. However, to date, when the train control device is switched off, it is not possible to determine whether the standstill of the train required in this operating mode was actually adhered to. If, at the end of operation, trains are switched off completely in parking positions, the precise fail-safe train position is lost. On the reactivation of the train, the fail-safe position of the train is not known and the initialization of the train position can only be determined by slowly driving over at least two spatial reference points, for example beacons. Only after this can the train be put into operation from the viewpoint of train safety. This means that automated, driverless trains in parking positions must not be switched off completely. At least, the train control device has to remain active. The main disadvantage is the significant energy requirement needed for this.

To save energy, all unnecessary consumers, for example the lights and air-conditioning system, in the train have to be switched off by the train control device on parking. Only the train control device has to remain active. This involves a power input of about 200 W to 400 W, depending upon the configuration of the train.

In the case of electric traction, if possible, the main traction current switches should also be switched off and possibly the pantographs applied in order to separate the train or locomotive from the traction voltage.

However, independently of the switching-off of trains or locomotives, the traction voltage is regularly switched off during breaks in operation due to work in the region of the route. It is frequently necessary to switch off the current system, in particular the traction current, for example for maintenance work, during the break in operation, generally in the night between 1:00 hrs and 4:00 hrs. It is then necessary to use battery current to maintain the functionality of the train control device. The essential functions requiring power are position monitoring or localization of the train and the reactivation of the switched-off components. If no position determination of this kind is available on reactivation, the train cannot be put into driverless operation immediately. The train has to be switched on manually at the parking position. Automated, driverless operation of the train is only possible following a complete position determination, for example by means of driving over two beacons.

To prevent a total outage of the train control device and hence not lose the position determination function, the time without any power supply has to be bridged by the use of batteries. To ensure that, during the different lengths of the breaks in operation in which no power system is available, the power supply for the train control device is guaranteed, the capacity of the batteries is dimensioned very high. These over-dimensioned batteries for safety reasons are very large and heavy so that they are an impediment with respect to energy-efficiency travel. In addition, batteries are expensive to procure and maintain.

In order to enable the train control device to be switched off without losing the position determination function, it was suggested in DE 10 2010 061 878 AI that the position determined by means of an odometer before the train control device is switched off be stored and that this position be used as an initialization position following reactivation. A necessary fail-safe condition for the suitability for use of the stored train position is that the train has not been moved while the train control device was switched off—CMD/cold movement detection. If, despite this, the train has been moved, for example for purposes of repair work performed on another section of the track, staff must be prevented from using the original position for initialization purposes. This non-technical solution is often not feasible in reality. In addition, during the phases in which the train control device is switched off, the odometer device provided for position monitoring requires a power supply and possibly battery current.

During automated, unaccompanied travel by means of an in-vehicle automatic train control device, it is also attempted to carry out the stripping down and re-fitting of the trains automatically in order to achieve greater flexibility with train scheduling without the use of staff.

BRIEF SUMMARY OF THE INVENTION

The invention is based on the object of disclosing an automated method and a route and train configuration suitable for carrying out this method for more energy-efficient switching-off and switching-on of a train in a parking position without the use of staff.

According to the invention, the object is achieved by the following method steps:

A) entering the parking position, wherein a train reclosing unit establishes an electrical connection with a coupling module on the route side that is connected to the train monitoring system, B) switching-off subsystems on the train side by means of the train control device and shutting-down the train control device, C) shutting-down and switching-off the train control device, D) event-triggered reactivation of the train control device with the aid of the train reclosing unit, E) switching-on the remaining subsystems of the train by means of the train control device and F) exiting the parking position, wherein the electrical connection between the train reclosing unit and the coupling module is separated.

To carry out this method, a route and train configuration is provided with which a coupling module is provided on the route side that is connected to the train monitoring system via a communication interface, which can be electrically connected to a train reclosing unit in the parking position.

This means that the location information is also available in the parking position and during the time when the train receives no power supply because the parking position is known from the physical connection to the coupling module. Following the reactivation of the train by means of the train reclosing unit, the train is located immediately without any requirement for beacons to be driven over. This enables driverless, automated operation to take place in the train parking region without manual intervention. The technical devices required are frequently already available. Moreover, the batteries required according to the state of the art can be dispensed with. Finally, energy consumption during the parking period is reduced to zero.

The parking position is monitored in that an electrical connection is established to a specific track-side coupling module of an assigned identification or ID. The train monitoring system establishes whether the ID corresponds to the intended ID. To this end, on the engagement of the electrical connection, a current pulse is generated which generates an ID-specific telegram, which is received by the monitoring system. The electrical connection also supplies current to the train reclosing unit. The train control device, for example an ATC—automatic train control—vehicle device can be switched off and does not have to be constantly supplied by large, heavy, expensive and over-dimensioned batteries in order to bridge intervals of different lengths when the traction current is switched off, for example, in the case of repair work in order to avoid any data loss.

The automatic train control can be completely shut down during the parking time since the train reclosing unit is used to reactivate the train control. In addition, the train reclosing unit does not require a battery, since the train reclosing unit receives current from the coupling module. This makes the train lighter thus enabling more energy-efficient traveling.

Position monitoring in the sense of CMD is much simpler than the case with "real" measuring methods, for example using odometers, since it is only necessary to determine whether the train has the same position at the end of the parking time—still or again—as at the start of the parking time. An interruption to the electrical connection between the train reclosing unit and the coupling module is sufficient to establish a movement or a connection error. The fact that the position has to be still the same is automatically determined by the fact that otherwise it would not be possible to restart the train control device since then the train reclosing unit would not have any power supply. This results in a fail-safe condition which is particularly important with fully automated operation.

A particularly advantageous development of the automatic method consists in that, following Step B), the traction current is cut off by means of the train monitoring system. The fact that traction current and battery current are not required for either the train control device or the train localization and are also not required for the train reclosing unit results in further energy saving. The traction current can also be switched off when the switching-off of the traction current is not necessary for maintenance or repair reasons.

Preferably, the activation of the train reclosing unit according to Step D) is triggered by one of the following events or also by a combination thereof:

- reaching a preset time,
- completion of a preset time interval,
- restoration of the traction voltage,
- undershooting of a minimum air pressure in the brake system,
- drop in temperature below a first threshold,
- rise in temperature above a second threshold
- reaching a temperature-dependent lead time before the preset time,
- radio reception of an activation command from the automatic monitoring system and/or
- exceptionally, manual activation.

An example of a possible combination could be: switching-on 10 minutes following the restoration of the traction voltage but not before the preset time and immediately on radio reception of an activation command.

At the same time, the advantage which is obtained over manual activation is that timely switching-on of the train or the locomotive is possible with the aid of the train reclosing unit, wherein allowance is made for a time interval between the activation of the train reclosing unit according to Step D) and a possible start of a journey for the ramping-up of the subsystems, including filling a main air reservoir, self tests and possibly air conditioning.

In addition, the electrical connection between the train reclosing unit and the coupling module can be monitored by the train monitoring system. This results in a further increase in the safety of the signaling technology.

A further improvement to safety is obtained in that the parking position assigned to a coupling-module-specific identification is stored on a hard disk drive of the train and is used in Step D) for the initialization of the automatic train control.

The train reclosing unit is a component of the coupling module on the route side and can be connected to the automatic train control device by radio. This means that it is not necessary to equip each individual train with its own train reclosing unit. Apart from a radio module that can be actuated by the train reclosing unit external to the train, no special equipment is required in the train.

The invention is explained below in more detail with reference to the FIGURE.

BRIEF DESCRIPTION OF THE SINGLE VIEW OF THE DRAWING

The FIGURE shows a configuration for automated driving in a parking region of a route infrastructure.

DESCRIPTION OF THE INVENTION

The configuration is shown after a train 1 has entered a parking region. The train 1 is standing on a track 2 and has an electrical connection 4 to a coupling module 3 of a specific ID. For the train control, an automatic train monitoring system 5 is provided on the route side, which is connected via a wireless communication interface 6 to the coupling module 3. For the automatic train control, the train 1 is equipped with a train control device 7 which actuates various subsystems 8 of the train 1. The automatic train control device 7 is also connected to a train reclosing unit 9, which is supplied with power from the coupling module 3 external to the train via the electrical connection 4. Further connectors 10 on the train reclosing unit 9 are in particular used as trigger inputs for event-dependent, for example time-dependent and/or traction-voltage-dependent and/or activation-command-dependent, actuation of the train reclosing unit 9.

The following method is provided for the fully automatic switching-off and reactivation of the train 1 in the parking position:

The train 1 enters the parking position. This is achieved when the electrical connection 4 between the train reclosing unit 9 and power source external to the train the coupling module 3 on the route side locks into place. As a result, the parking position is known in accordance with the ID of the connected coupling module 3. After this, the automatic train control device 7 is activated by the train monitoring system 5 so that the automatic train control device 7 shuts down subsystems 8 on the train side. Following this, the automatic train control device 7 can itself be shut down and deenergized. The train reclosing unit 9 is not required for these switching-off processes. The traction current is switched off by the train monitoring system 5. Now, only the train reclosing unit 9 is supplied with power—externally.

When, following the completion of the parking time, the train monitoring system 5 switches the traction current back on and the train reclosing unit 9 receives a radio pulse from the train monitoring system 4, the train reclosing unit 9 switches on the train control device 7, which receives the position data for the self-initialization from the coupling module 3 and ramps up the subsystems 8. The train 1 can now—following self tests, filling with compressed air, possibly air conditioning etc—receive journey instructions from the train monitoring system 5 and decouple the electrical connection 4 between the train reclosing unit 9 and the coupling module 3 on exiting. Very few mobile members of staff 11 are required to intervene in the event of a power supply.

The train reclosing unit 9 enables the train control device 7 to be switched off so that there is no need for a large battery to bridge periods with different lengths when the traction current is switched off in order not to lose the position data for the initialization. In addition, it is always possible to switch off the traction current in the parking position. Since the power supply to the train reclosing unit 9 is provided externally with the coupling module 3 in the parking position, the train reclosing unit 9 also does not require a battery current supply. Finally, this results in a saving of energy and a battery-free train device thus enabling more energy-efficient travel.

The invention claimed is:

1. A method for switching a train off and on in a parking position, the method comprising the following steps:

providing a train-side automatic train control device and a route-side train monitoring system;

A) moving the train into the parking position, establishing an electrical connection between a train-side train reclosing unit and a route-side coupling module being connected to the train monitoring system and supplying the train reclosing unit with power from the coupling module through the electrical connection;

B) switching-off train-side subsystems by using the train control device;

C) shutting-down and switching-off the train control device;

D) carrying out event-triggered reactivation of the train control device aided by the train-side train reclosing unit;

E) switching-on subsystems of the train by using the train control device; and

F) exiting the parking position and separating the electrical connection between the train reclosing unit and the coupling module.

2. The method according to claim 1, which further comprises following step B) cutting-off traction current by using the train monitoring system.

3. The method according to claim 1, which further comprises triggering activation of the train reclosing unit according to step D) by at least one or a combination of the following events:

reaching a preset time, completion of a preset time interval, restoration of a traction voltage, undershooting of a minimum air pressure in a brake system, drop in temperature below a first threshold, rise in temperature above a second threshold, reaching a temperature-dependent lead time before the preset time, radio reception of an activation command from the automatic train monitoring system or manual activation.

4. The method according to claim 1, which further comprises between an activation of the train reclosing unit according to step D) and a possible start of a journey, providing a time interval for ramping-up the subsystems, including filling a main air reservoir, self tests and possibly air conditioning.

5. The method according to claim 1, which further comprises using the train monitoring system to monitor the electrical connection between the train reclosing unit and the coupling module.

6. The method according to claim 1, which further comprises assigning the parking position to a coupling-module-specific identification being stored on a hard disk drive of the train and used in step D) for initialization of the automatic train control device.

7. A route and train configuration for switching a train off and on in a parking position, the route and train configuration comprising:

a route-side train monitoring system;

a route-side coupling module;

a communication interface connecting said coupling module to said train monitoring system;

a train-side train reclosing unit to be electrically connected to said route-side coupling module in the parking position by an electrical connection for supplying said train-side train reclosing unit with power from said coupling module through said electrical connection;

a train-side automatic train control device to be reactivated with the aid of said train reclosing unit after deactivation; and train-side subsystems to be switched off and on by said train control device.

* * * * *